US008770266B2

(12) United States Patent
Sasaki et al.

(10) Patent No.: US 8,770,266 B2
(45) Date of Patent: Jul. 8, 2014

(54) APPARATUS AND METHOD FOR PRODUCING PISTON FOR INTERNAL COMBUSTION ENGINE

(71) Applicant: Hitachi Automotive Systems, Ltd., Hitachinaka (JP)

(72) Inventors: Masato Sasaki, Sagamihara (JP); Norikazu Takahashi, Yokohama (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 13/793,364

(22) Filed: Mar. 11, 2013

(65) Prior Publication Data

US 2013/0277005 A1 Oct. 24, 2013

(30) Foreign Application Priority Data

Apr. 18, 2012 (JP) ..... 2012-094356

(51) Int. Cl.

| | |
|---|---|
| ***B22D 33/04*** | (2006.01) |
| ***B41B 11/54*** | (2006.01) |
| ***B22D 17/02*** | (2006.01) |
| ***B22D 19/00*** | (2006.01) |
| ***B22C 9/10*** | (2006.01) |

(52) U.S. Cl.

CPC ..... *B22D 17/02* (2013.01); *B22D 19/0027* (2013.01); *B22C 9/10* (2013.01); *B22C 9/108* (2013.01)

USPC ..... 164/137; 164/340; 164/341; 249/160

(58) Field of Classification Search

CPC ..... B22C 9/10; B22C 9/105; B22C 9/108; B22D 17/00; B22D 17/02; B22D 19/00; B22D 19/0027

USPC ..... 164/4.1, 47, 137, 154.2, 271, 339–342, 164/DIG. 8; 249/160–162

See application file for complete search history.

(56) References Cited

FOREIGN PATENT DOCUMENTS

| | | |
|---|---|---|
| JP | 10-225748 A | 8/1998 |
| JP | 3548369 B2 | 4/2004 |

*Primary Examiner* — Keith Walker
*Assistant Examiner* — Steven Ha
(74) *Attorney, Agent, or Firm* — Crowell & Moring LLP

(57) ABSTRACT

An apparatus for producing a piston for an internal combustion engine by casting, the piston having a cooling channel therein, the apparatus including a fixed die with an upwardly opened cavity in which a core serving to form the cooling channel is to be disposed, a moveable die moveably disposed relative to the fixed die in a vertical direction and including a predetermined engaging portion, a guide die including an engaging portion engageable with the fixed die and having a same shape as that of the engaging portion of the moveable die, and a core retaining mechanism disposed in the guide die to retain the core in a predetermined position.

20 Claims, 14 Drawing Sheets

APPARATUS AND METHOD FOR PRODUCING PISTON FOR INTERNAL COMBUSTION ENGINE

BACKGROUND OF THE INVENTION

The present invention relates to an apparatus and method for producing a piston for an internal combustion engine of a vehicle such as an automobile which has a cooling channel therein.

A conventional piston for an internal combustion engine which is applied to an automobile is produced by metal mold casting as described in Japanese Patent No. 3548369.

Specifically, a soluble core serving for forming a cooling channel is fixedly arranged in a die, and then, a molten metal is poured into the die to thereby form a workpiece for a piston. After that, the workpiece is withdrawn from the die, and the core is dissolved and removed by water and the like. Thus, the piston with the cooling channel is formed.

SUMMARY OF THE INVENTION

It is necessary to fulfill a predetermined positional relationship between the die and the core. For this reason, in the conventional method, the core is fixedly arranged in the die by a manual operation. As a result, the production work becomes complicated, and reduction in cost cannot be sufficiently attained.

The present invention was made in consideration of the above-described problems in the technology of the conventional art. An object of the present invention is to provide an apparatus and method for producing a piston for an internal combustion engine which is capable of improving an operating efficiency in arrangement of a core in a die.

The other objects and features of this invention will become understood from the following description with reference to the accompanying drawings.

In a first aspect of the present invention, there is provided an apparatus for producing a piston for an internal combustion engine by casting, the piston having a cooling channel therein, the apparatus including:

a fixed die with an upwardly opened cavity in which a core serving to form the cooling channel is to be disposed;

a moveable die moveably disposed relative to the fixed die in a vertical direction, the moveable die including a predetermined engaging portion, the moveable die being inserted and engaged in the fixed die through the engaging portion to thereby serve to form a crown surface of the piston, a guide die including an engaging portion engageable with the fixed die, the engaging portion of the guide die having a same shape as that of the engaging portion of the moveable die, and a core retaining mechanism disposed in the guide die, the core retaining mechanism serving to retain the core in a predetermined position, wherein after the guide die retaining the core through the core retaining mechanism is engaged with the fixed die to arrange the core in the cavity, the guide die is moved apart from the fixed die, and then the moveable die is inserted and engaged in the fixed die to thereby carry out casting of the piston.

In the apparatus according to the first aspect of the present invention, the guide die (jig) having a same engaging portion as that of the fixed die is provided, and the core is arranged within the cavity of the fixed die through the guide die. With this construction, the core can be automatically arranged in a proper position within the cavity. As a result, an operation of arrangement of the core in the die can be automated, thereby serving for enhancing productivity of the piston.

In a second aspect of the present invention, there is provided the apparatus according to the first aspect, wherein the engaging portion of the moveable die and the engaging portion of the guide die each have a generally cylindrical shape, wherein the fixed die includes an aperture that is opened to an upper surface of the fixed die and communicated with the cavity, the aperture having a circular shape in section and serving as a counterpart engaging portion engageable with the engaging portion of the moveable die and the engaging portion of the guide die, and wherein the engaging portion of the moveable die and the engaging portion of the guide die are engaged with the counterpart engaging portion to carry out positioning of the moveable die and the guide die relative to the fixed die in a horizontal direction.

In a third aspect of the present invention, there is provided a method for producing a piston for an internal combustion engine by casting using an apparatus, the piston having a cooling channel therein, the apparatus including:

a fixed die with an upwardly opened cavity in which a core serving to form the cooling channel is to be disposed;

a moveable die moveably disposed relative to the fixed die in a vertical direction, the moveable die including a predetermined engaging portion, the moveable die being inserted and engaged in the fixed die through the engaging portion to thereby serve to form a crown surface of the piston, a guide die including an engaging portion engageable with the fixed die, the engaging portion of the guide die having a same shape as that of the engaging portion of the moveable die, and a core retaining mechanism disposed in the guide die, the core retaining mechanism serving to retain the core in a predetermined position, the method including:

a first step of retaining the core in a predetermined position through the core retaining mechanism;

a second step of inserting and engaging the guide die in the fixed die to thereby carry out positioning of the guide die relative to the fixed die through the engaging portion of the guide die;

a third step of arranging the core in the cavity of the fixed die through the core retaining mechanism;

a fourth step of removing the guide die from the fixed die; and a fifth step of inserting and engaging the moveable die in the fixed die.

In a fourth aspect of the present invention, there is provided the apparatus according to the second aspect, wherein the engaging portion of the moveable die and the engaging portion of the guide die each include a tapered guide portion through which the moveable die and the guide die are guided to the fixed die and inserted and engaged in the fixed die.

With this construction, insertion ability of the moveable die and the guide die relative to the fixed die can be enhanced. As a result, it is possible to obtain good productivity of the piston and enhance positioning accuracy by the engaging portion, thereby serving for effectively automating arrangement of the core.

In a fifth aspect of the present invention, there is provided the apparatus according to the first aspect, wherein the core includes a fitting portion through which the core is fittable to a support disposed in the fixed die, the fitting portion being fitted to the support to thereby secure and arrange the core in the cavity of the fixed die through the support.

With this construction, proper positioning of the core can be carried out. Further, it is possible to ensure quality and yield of the piston and suppress such a problem that the core rises to a surface of the molten metal poured into the cavity during pouring the molten metal. As a result, casting of the piston having a cooling channel can be effectively carried out. Further, a continuous cooling channel can be formed by the core and the support to thereby minimize an additional work for forming the cooling channel.

In a sixth aspect of the present invention, there is provided the apparatus according to the fifth aspect, wherein the fitting portion is in the form of a concaved portion, and the support is in the form of a projection disposed to uprightly project from an inner bottom surface of the fixed die.

With this construction, the core can be secured to the fixed die only by pushing the core toward the support from an upper side of the core. As a result, it is possible to ensure good productivity of piston 1. Further, a continuous cooling channel can be formed by the core and the support to thereby minimize an additional work for forming the cooling channel.

In a seventh aspect of the present invention, there is provided the apparatus according to the first aspect, wherein the core retaining mechanism is constructed to retain the core in a state centered relative to the core retaining mechanism.

With this construction, the core can be retained in a state centered relative to the core retaining mechanism. As a result, positioning of the core relative to the fixed die can be readily carried out.

In an eighth aspect of the present invention, there is provided the apparatus according to the seventh aspect, wherein the core retaining mechanism is constructed to adjust a position of the core in a rotational direction thereof.

With this construction, it is possible to adjust displacement of the core in the rotational direction upon retaining the core by the core retaining mechanism. As a result, positioning of the core relative to the fixed die can be more readily carried out.

In a ninth aspect of the present invention, there is provided the apparatus according to the eighth aspect, wherein the position of the core in the rotational direction is detected by an image analyzer.

With this construction, the position of the core in the rotational direction can be detected in a non-contact condition, and therefore, it is possible to perform detection and adjustment of the position of the core in the rotational direction with a more simple construction.

In a tenth aspect of the present invention, there is provided the apparatus according to the seventh aspect, wherein the core retaining mechanism is supported so as to be slidable relative to the guide die.

With this construction, upon utilizing the positioning of the core through the guide die, the core can be straightly inserted into the cavity from above.

In an eleventh aspect of the present invention, there is provided the apparatus according to the tenth aspect, wherein the core retaining mechanism is slidable by an air cylinder disposed on the guide die.

With this construction, it is possible to readily carry out control of arrangement of the core by the core retaining mechanism.

In a twelfth aspect of the present invention, there is provided the apparatus according to the tenth aspect, wherein the core retaining mechanism includes a spring that biases the guide die in a direction in which the core retaining mechanism is slidable and which is opposite to a direction in which the core is assembled to the fixed die.

With this construction, it is possible to lock the core on fitting projections with substantially no impact, and thereby suppress a problem that the core is broken.

In a thirteenth aspect of the present invention, there is provided the apparatus according to the seventh aspect, wherein the core has a generally annular shape, and the core retaining mechanism includes a plurality of retaining portions disposed on an inner peripheral side of the core so as to be moveable from a radially inner side of the core toward a radially outer side of the core.

With this construction, even in a case where a space on an outer peripheral side of the core is small due to a relation with the fixed die (a shape of the cavity), centering of the core can be attained.

In a fourteenth aspect of the present invention, there is provided the apparatus according to the seventh aspect, wherein the core has a generally annular shape, and the core retaining mechanism includes a plurality of retaining portions disposed on an outer peripheral side of the core so as to be moveable from a radially outer side of the core toward a radially inner side of the core.

With this construction, even in a case where a space on an inner peripheral side of the core is small due to a relation with the fixed die (a shape of the cavity), centering of the core can be attained.

In a fifteenth aspect of the present invention, there is provided the apparatus according to the thirteenth aspect, wherein the core retaining mechanism drives the retaining portions by air pressure.

In a sixteenth aspect of the present invention, there is provided the apparatus according to the first aspect, wherein the core has an annular shape.

In a seventeenth aspect of the present invention, there is provided the apparatus according to the sixth aspect, wherein the core is made of a material containing sodium chloride as a main component.

With this construction, production of the core and removal of the core after casting can be readily carried out to thereby serve for enhancing productivity of the piston.

In an eighteenth aspect of the present invention, there is provided the method according to the third aspect, wherein the first step includes centering the core relative to the core retaining mechanism.

In a nineteenth aspect of the present invention, there is provided the method according to the eighteenth aspect, wherein the engaging portion of the guide die includes a tapered guide portion formed on a side of a tip end of the engaging portion of the guide die, and the second step includes correcting displacement of the guide die relative to the fixed die by sliding the tapered guide portion on an inner peripheral surface of an aperture that is opened to an upper surface of the fixed die and communicated with the cavity in a case where the guide die is displaced relative to the fixed die.

With this construction, displacement of the guide die relative to the fixed die can be automatically and readily corrected to thereby serve for ensuring good productivity of the piston.

In a twentieth aspect of the present invention, there is provided the apparatus according to the second aspect, wherein the counterpart engaging portion of the fixed die comprises a tapered guide portion through which the moveable die and the guide die are respectively guided to the fixed die and inserted and engaged in the fixed die.

With this construction, it is possible to serve for good insertion and engagement of the moveable die and the guide die in the fixed die.

DETAILED DESCRIPTION OF THE INVENTION

Embodiments of an apparatus and method for producing a piston for an internal combustion engine, according to the present invention, will be described in detail hereinafter by referring to the accompanying drawings. In the following embodiments, an exemplary explanation is made as to a piston to be applied to an automobile engine.

Figure 1:
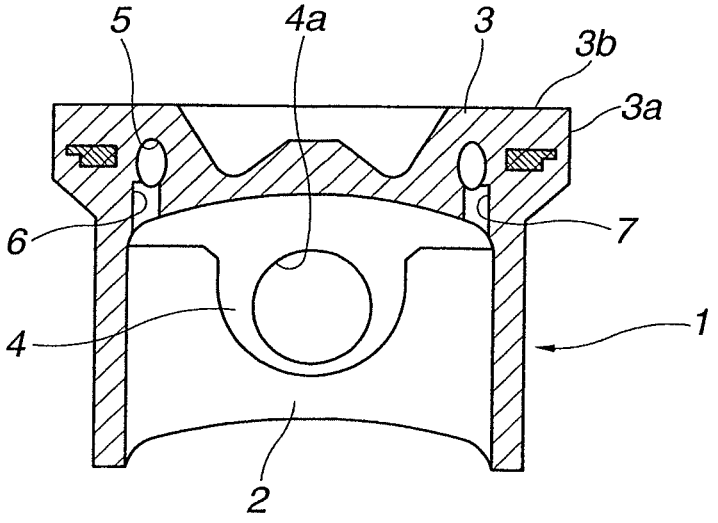
FIG. 1 is a longitudinal sectional view of a piston that is produced by an apparatus for producing a piston for an internal combustion engine according to a first embodiment of the present invention.

Referring to FIG. 1 to FIG. 13, the apparatus and method according to a first embodiment of the present invention is explained. FIG. 1 shows piston 1 that is formed by the apparatus and method according to the first embodiment of the present invention (hereinafter referred to simply as "a piston"). Piston 1 may be formed by casting an aluminum alloy material, for instance, AC8A. As shown in FIG. 1, piston 1 includes cylindrical piston skirt 2, piston crown 3 integrally formed on an upper end of piston skirt 2, and generally cylindrical pin bosses 4, 4 integrally formed on an inner circumferential surface of piston skirt 2 so as to be opposed to each other. Pin bosses 4, 4 have pin holes 4*a*, 4*a* therein which serve to support both ends of a piston pin (not shown).

Examples of a material of piston 1 may include AC8A, aluminum casting alloys other than AC8A, and magnesium casting alloys.

Piston crown 3 includes increased thickness portion 3*a* formed along a circumferential direction of piston crown 3. Increased thickness portion 3*a* has a plurality of ring grooves (not shown) on an outer circumferential surface thereof, and cooling channel 5 on an inside thereof. Cooling channel 5 has a generally annular shape and serves to cool piston crown 3 with a flow of a cooling medium such as an oil.

Formed on an inner surface of increased thickness portion 3*a* is introduction hole 6 and discharge hole 7 which are opened into cooling channel 5 and serve for introduction and discharge of the oil, respectively. That is, the oil introduced from introduction hole 6 passes through cooling channel 5, and is discharged from discharge hole 7. Thus, the oil is allowed to flow in one direction. Specifically, the oil is introduced to introduction hole 6 by an oil jet (not shown) disposed in the vicinity of a bottom dead center position of piston 1 in the engine cylinder. The oil discharged from discharge hole 7 is circulated into the engine.

As described above, in piston 1, a part of the oil which serves for lubrication of respective slide portions in the engine is introduced to cooling channel 5 and circulated in cooling channel 5. As a result, it is possible to cool piston crown 3 and the ring grooves where the temperature becomes highest in the engine due to conduction of heat from a combustion chamber of the engine.

Next, the apparatus for producing piston 1 by metal mold casting (casting apparatus) is explained.

Figure 2:
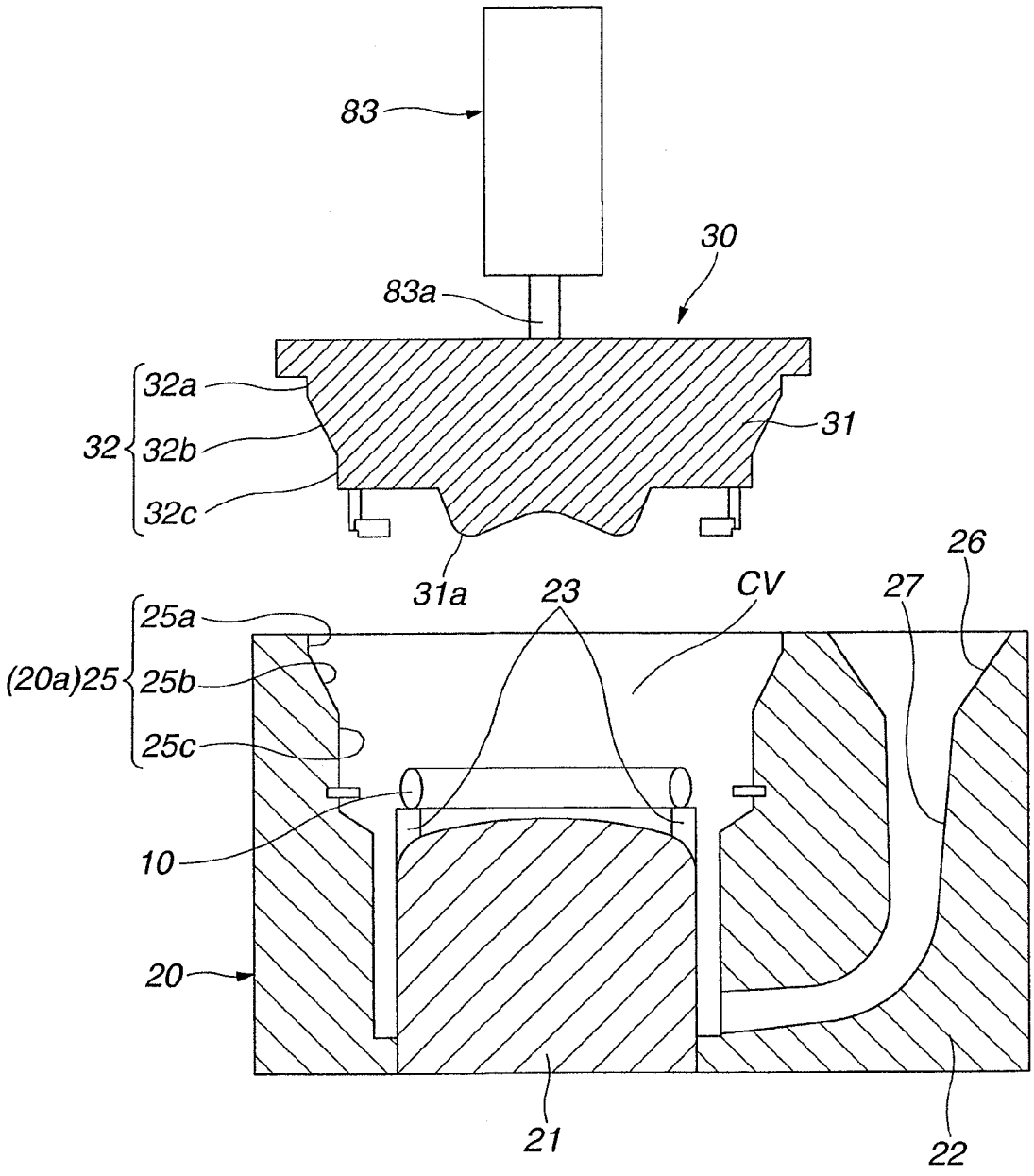
FIG. 2 is a sectional view of an essential part of the apparatus according to the first embodiment of the present invention, and shows usage of the apparatus in a pouring (casting) step of a method for producing the piston according to the present invention.
Figure 3:
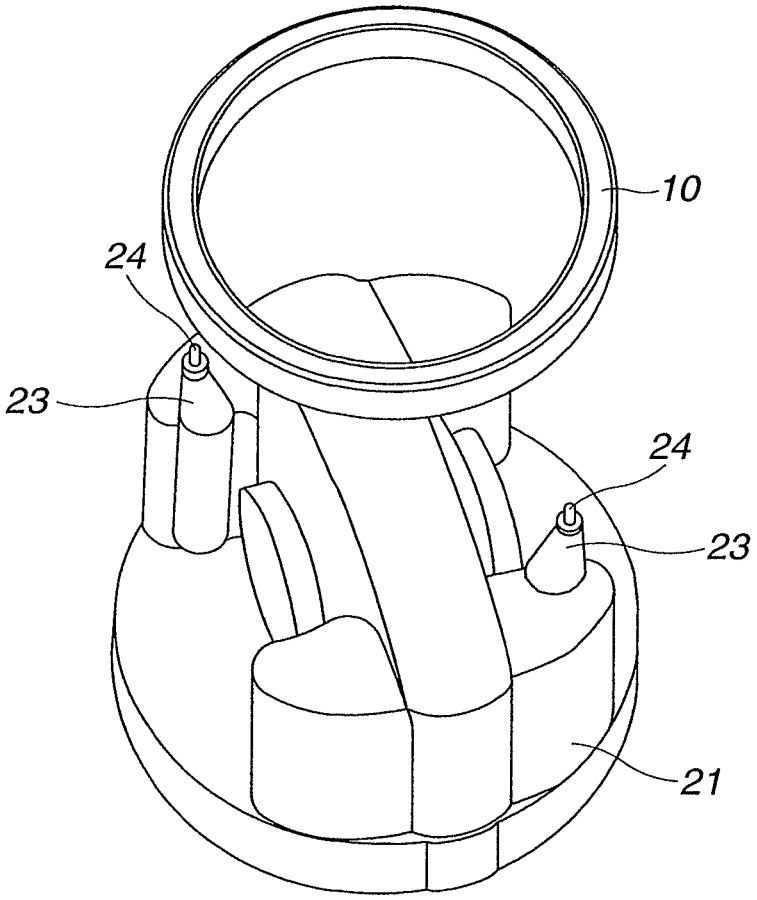
FIG. 3 is a perspective view of a first die of a fixed die, and shows a concrete shape of the first die.

Specifically, as shown in FIG. 2 and FIG. 3, the casting apparatus includes fixed die (or mold) 20 with aperture 20*a* that is upwardly opened to define cavity CV, and moveable die 30 disposed above fixed die 20 so as to be moveable in a vertical direction (up-and-down direction). Moveable die (or mold) has core body 31 at a lower end portion thereof, and serves to mold crown surface 3*b* of piston 1 by inserting core body 31 into aperture 20*a* of fixed die 20 to engage core body 31 in aperture 20*a*. The casting apparatus also includes a drive mechanism (not shown) for driving moveable die 30 and jig 40 as explained later, and a control mechanism (not shown) for controlling movement of moveable die 30 and jig 40. A molten metal is poured by gravity into fixed die 20 in which soluble core 10 is supported and arranged, thereby casting piston workpiece 1*a* that is to be an original form of piston 1. In this embodiment, soluble core 10 (hereinafter referred to simply as "core") is a so-called salt core that is formed by compressing and compacting a material containing sodium chloride as a main component into a ring shape. By thus using the salt core as core 10, production of core 10 and removal of core 10 after casting can be readily carried out to thereby serve for enhancing productivity of piston 1.

The salt core used as core 10 in this embodiment which serves to form cooling channel 5 may be replaced with a collapsible core such as a sand core formed of sand as a main material according to uses.

Fixed die 20 is constituted of a plurality of separable or splittable die parts capable of being disassembled. Fixed die 20 includes first die part 21 mainly serving for molding an inner peripheral portion of piston 1, and second die part 22 mainly serving for molding an outer peripheral portion of piston 1. Second die part 22 is constituted of a pair of split die halves, and is disposed in a region along an outer periphery of first die part 21. First die part 21 and second die part 22 cooperate with each other to form the cavity CV.

As shown in FIG. 3, first die part 21 has a generally cylindrical shape, and has an upper end portion having a shape corresponding to that of the inner peripheral portion of piston 1. A pair of supports 23, 23 are disposed to uprightly project from the upper end portion of first die part 21. Supports 23, 23 are located in positions respectively corresponding to introduction hole 6 and discharge hole 7, and serve for forming these holes 6, 7 and supporting and arranging core 10. Supports 23, 23 are each formed into a similar frusto-conical shape, and have fitting projections 24, 24 on upper surfaces thereof, respectively. Fitting projections 24, 24 are engageable with a pair of fitting holes 11, 11 formed in a bottom surface of core 10. Fitting projections 24, 24 are formed into an elongated rod shape, and are configured to be engageable with core 10 even in a case where fitting holes 11, 11 are not formed in core 10. An amount of projection (amount of embedding) of fitting projections 24, 24 is set to be enough to fix core 10.

Second die part 22 is hollowed and has counterpart engaging portion 25 in an inner periphery of an upper end portion thereof. Counterpart engaging portion 25 defines an upper-end aperture of the cavity CV, and serves for engagement with core body 31. Counterpart engaging portion 25 is configured to reduce a diameter toward an inside (lower side) of second die 22. Counterpart engaging portion 25 includes large diameter bored portion 25*a*, conical tapered bored portion (hereinafter referred to simply as "tapered bored portion") 25*b*, and small diameter bored portion 25*c*. Large diameter bored portion 25*a* is disposed in an outer end portion (upper end portion) of counterpart engaging portion 25 which is exposed to an outside, and serves for positioning of moveable die 30 in a horizontal direction. Tapered bored portion 25*b* has a diameter gradually reduced from the side of large diameter bored portion 25*a* toward an inside (lower side) of counterpart engaging portion 25. Small diameter bored portion 25*c* is disposed in an inner end portion (lower end portion) of counterpart engaging portion 25 which is a tip end portion of tapered bored portion 25*b*.

Further, second die part 22 includes runner 27 that extends through second die part 22. Runner 27 has one end that serves as gate 26 and is opened to an outside, and the other end opened into the cavity CV. That is, the molten metal poured from the outside through gate 26 is introduced into the cavity CV through runner 27.

Moveable die 30 is supported by a moving mechanism (not shown), and is moved from an upper side of the cavity CV so as to open and close the cavity CV. Piston surface 3*b* of piston 1 is formed by tip end surface 31*a* of core body 31. An example of the moving mechanism may be hydraulic cylinder 83 as shown in FIG. 2.

Core body 31 has engaging portion 32 on an outer periphery thereof. Engaging portion 32 has a shape corresponding to that of counterpart engaging portion 25 of fixed die 20 (second die part 22), and is engaged with counterpart engaging portion 25 to thereby perform positioning of moveable die 30 in a radial direction thereof with respect to fixed die 20. Specifically, engaging portion 32 includes large diameter shaft portion 32*a*, conical tapered shaft portion (hereinafter referred to simply as "tapered shaft portion") 32*b*, and small diameter shaft portion 32*c*. Large diameter shaft portion 32*a* is engageable with large diameter bored portion 25*a* of fixed die 20 with almost no clearance, and serves for positioning of moveable die 30. Tapered shaft portion 32*b* and small diameter shaft portion 32*c* are engageable with tapered bored portion 25*b* and small diameter bored portion 25*c* of fixed die 20 with predetermined clearances in the radial direction, respectively.

Figure 4:
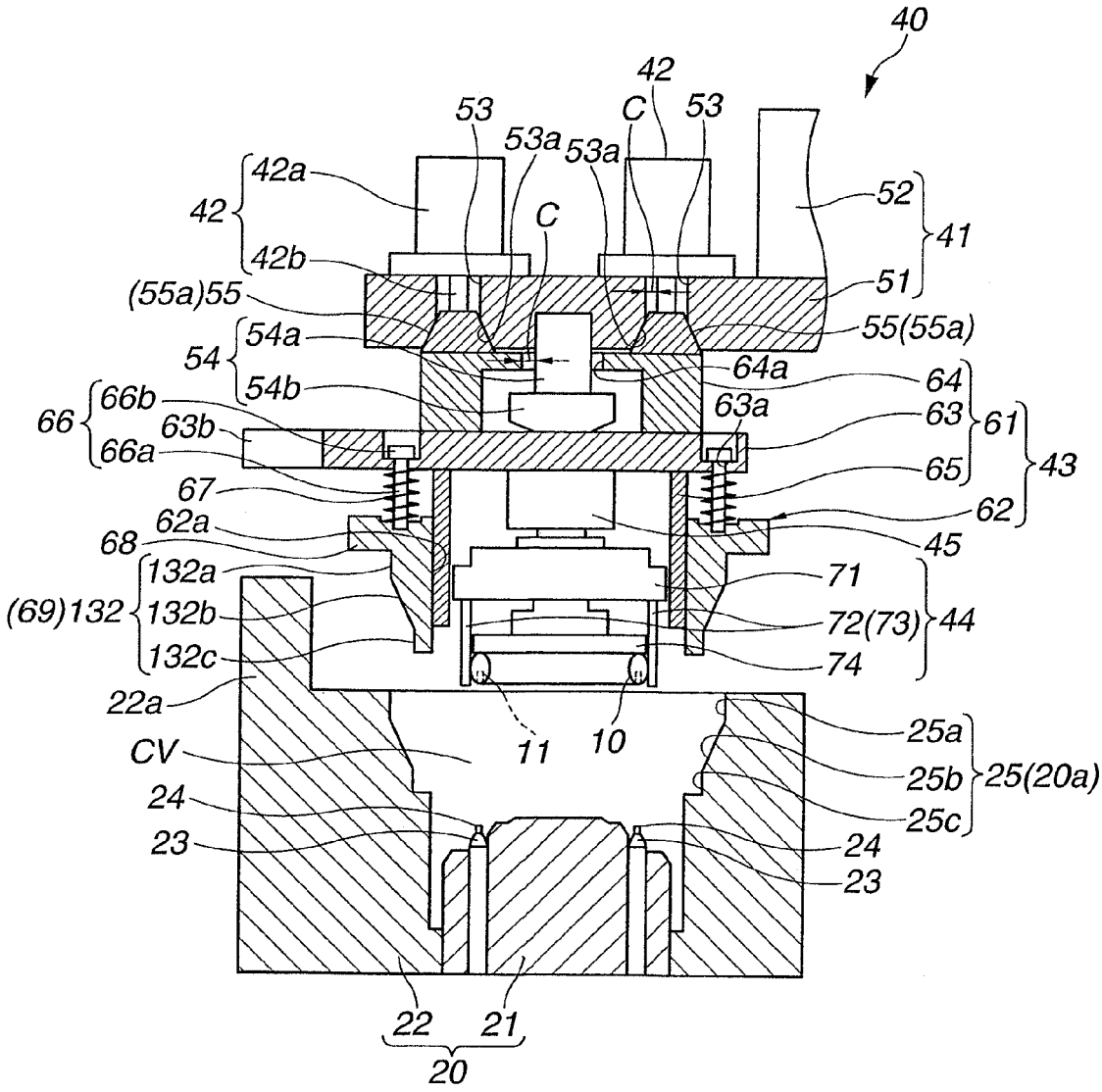
FIG. 4 is a sectional view of an essential part of the apparatus according to the first embodiment of the present invention, and shows usage of the apparatus in a step of arranging a core in the method of the present invention.

Further, in this embodiment of the present invention, fixing arrangement of core 10 in the cavity CV which has been carried out by a manual operation in the conventional art as described above, can be automatically carried out using predetermined jig 40. Specifically, as shown in FIG. 4, jig 40 includes support member 41, two pairs of air cylinders 42, 42 supported on support member 41, jig body 43 suspended from support member 41 and supported so as to ascend and descend through air cylinders 42, 42, and core retaining mechanism 44 for retaining core 10 upon fixing arrangement of core 10. Support member 41 serves to transport jig 40 by a transport machine (not shown) such as a robot arm. Air cylinders 42, 42 are disposed at an upper portion on both sides of support member 41. Jig body 43 includes engaging portion 32 similar to that of core body 31 of moveable die 30 so as to be engageable with fixed die 20. Core retaining mechanism 44 is connected to a central-lower portion of jig body 43 through stepping motor 45. Jig 40 serves as a part of the casting apparatus and is operationally associated with the casting apparatus to automatically carry out the whole process of casting piston 1. Meanwhile, in the drawings, only one part of a so-called multi-cavity die (in this embodiment, two-cavity die) is shown, and illustration of the other part thereof is omitted (see FIG. 4 to FIG. 9).

In this embodiment, air cylinders 42, 42 are used as a drive device for jig body 43, so that drive control of jig body 43 can be readily performed. Further, owing to non-use of oil for driving jig body 43, maintenance of the apparatus can be enhanced.

However, hydraulic cylinders may be substituted for air cylinders 42, 42 in accordance with uses.

Support body 41 includes pedestal 51 serving for supporting air cylinders 42, 42, and handle 52 that is formed integrally with pedestal 51 and is held by the transport machine (not shown). Pedestal 51 is shaped into a generally flat plate, and has a pair of rod insertion holes 53, 53 in both end portions thereof in a width direction thereof. Rod insertion holes 53, 53 extend through pedestal 51 in parallel with each other, serving for insertion of rods 42*b*, 42*b* of air cylinders 42, 42. Each of rod insertion holes 53, 53 has an inner diameter sufficiently larger than an outer diameter of each of rods 42*b*, 42*b* of air cylinders 42, 42 such that sufficiently large radial clearance C between an inner peripheral surface defining rod insertion hole 53 and an outer peripheral surface of rod 42*b* can be ensured. With the provision of the radial clearance C, a floating mechanism as explained later can be effectively operated. Further, each of rod insertion holes 53, 53 is formed with tapered portion 53*a* located on a lower side of rod insertion hole 53, that is, on a side opposite to the side provided with air cylinders 42, 42. Tapered portion 53*a* has a diameter decreased upwardly from a lower open end thereof that is opened to a lower end surface of pedestal 51.

Handle 52 is disposed to upwardly project on an upper portion of pedestal 51 in a generally central position in the width direction of pedestal 51 between each pair of air cylinders 42, 42. Jig 40 as a whole can be transported via handle 52 by grasping the handle with the transport machine. On the other hand, reversed bolt-shaped restraint members 54, 54 are disposed to downwardly project from a lower surface of pedestal 51 between rod insertion holes 53, 53 in the both end portions of pedestal 51. Restraint members 54, 54 serve to restrain the descending movement of jig body 43 by air cylinders 42, 42 to a lowest limit position.

Each of restraint members 54, 54 includes shaft portion 54*a* and restraining portion 54*b* formed on a lower end of shaft portion 54*a*. Shaft portion 54*a* is fixed to pedestal 51 at an upper end thereof, whereas a lower end of shaft portion 54*a* is inserted into support hole 64*a* of jig body 43. Thus, shaft portion 54*a* permits support body 41 to move relative to jig body 43 in a predetermined region. Restraining portion 54*b* has a diameter larger than a diameter of shaft portion 54*a* so that restraint members 54 has a stepped bolt shape. The diameter of restraining portion 54*b* is larger than a diameter of support hole 64*a*, so that restraining portion 54*b* can interfere with jig body 43 to thereby restrain a movement of support body 41 relative to jig body 43. That is, an outer periphery of an upper end surface of restraining portion 54*b* is engaged with a periphery of support hole 64*a*, so that a unitary movement (ascending movement) of support body 41 and jig body 43 is allowed. Further, a lower end surface of restraining portion 54*b* is contacted with an upper surface of base portion 63 of jig body 43, thereby restraining a farther movement (descending movement) of support body 41 relative to jig body 43.

Air cylinders 42, 42 are supported on pedestal 51 in such a state that flanges formed on lower ends of cylinders 42*a*, 42*a* are engaged with upper peripheries of rod insertion holes 53, 53 formed on an upper end surface of pedestal 51. Disposed on tip ends of rods 42*b*, 42*b* are connecting members 55, 55 that serve to connect jig body 43 (body 61 as explained later). Each of connecting members 55, 55 has a generally frusto-conical shape having an outer diameter larger than that of each of rods 42*b*, 42*b*. Connecting member 55 includes a relatively small diameter upper end portion fixed to rod 42*b*, and a relatively large diameter lower end portion fixed to link portion 64 of body 61. Connecting member 55 serves to allow a unitary movement of air cylinders 42, 42 and jig body 43.

Further, when support body 41 is moved relative to air cylinders 42, 42, connecting members 55, 55 each formed as tapered portions 55*a*, 55*a* are brought into engagement with tapered portions 53*a*, 53*a* of rod insertion holes 53, 53, thereby serving to limit (lock) a floating operation of jig body 43 by the floating mechanism as explained later. Thus, the floating operation of jig body 43 by the floating mechanism can be locked in a step of picking up core 10 as explained later, while ensuring the floating operation. As a result, the operation of the apparatus can be carried out with high accuracy.

Jig body 43 includes generally cylindrical body 61 and generally cylindrical guide die 62 supported on an outer periphery of a lower end portion of body 61 so as to be moveable relative to body 61. Body 61 is upwardly and downwardly moveably supported on support body 41 through air cylinders 42, 42. Guide die 62 has engaging portion 32 similar to engaging portion 32 of moveable die 30, on an outer periphery of guide die 62. Core retaining mechanism 44 is accommodated on an inner peripheral side of guide die 62, and is mounted to the lower end portion of body 61.

Body 61 includes generally flat plate-shaped base portion 63 as a base, link portion 64 disposed on an upper surface of base portion 63 which serves for linking with restraint member 54 and the respective pairs of air cylinders 42, 42, and generally cylindrical hollowed guide portion 65 downwardly projecting on a lower portion of base portion 63. Guide portion 65 has an outer peripheral surface that is brought into slide contact with on an inner peripheral surface of guide die 62, thereby guiding guide die 62 to allow descending and ascending movement of guide die 62.

Base portion 63 has a generally disk shape, and has a plurality of pin insertion holes 63*a* on an outer periphery thereof. Pin insertion holes 63*a* extend through base portion 63, and serve for arrangement of support pins 66 that support guide die 62 in a suspended state. Each of support pins 66 has a bolt shape, and includes shaft portion 66*a* inserted into each of pin insertion holes 63*a*, and retaining portion 66*b* disposed on an upper end of shaft portion 66*a*. Retaining portion 66*b* has an increased diameter so as to be engaged with a peripheral portion that defines pin insertion hole 63*a*, thereby being supported on base portion 63. Shaft portion 66*a* is fixed to guide die 62 at a lower end portion thereof. With this construction, guide die 62 is suspended on base portion 63. Coil springs 67 are installed on support pins 66, and disposed between base portion 63 and guide die 62. That is, body 61 is allowed to move relative to guide die 62 in accordance with an air pressure applied by air cylinders 42, 42 and a pressing force of support body 41 as follows. Body 61 is descended against the biasing force of coil springs 67 by the air pressure of air cylinders 42, 42 and the pressing force of support body 41, and body 61 is ascended by the biasing force of coil springs 67 with cancellation of the air pressure of air cylinders 42, 42 and the pressing force of support body 41.

Further, base portion 63 includes key-shaped engaging groove 63*b* formed in a predetermined position in a circumferential direction of base portion 63. Engaging groove 63*b* is provided in the form of a cutout extending through base portion 63 along in a radial direction of base portion 63. Engaging groove 63*b* is engageable with engaging projection 22*a* formed on an upper surface of fixed die 20. Engaging projection 22*a* and engaging groove 63*b* cooperate to constitute a displacement prohibiting mechanism (so-called detent mechanism) for prohibiting displacement of body 61 in a rotational direction thereof. With the provision of the displacement prohibiting mechanism, an operation of insertion and arrangement of core 10 as explained later can be well performed.

Link portion 64 has a generally cylindrical hollowed column shape with a closed end, and is uprightly disposed on the upper surface of base portion 63 in such a way that a lower end of link portion 64 is fixed to the upper surface of base portion 63. Link portion 64 has support hole 64*a* in a central position of an upper wall thereof. Support hole 64*a* has an inner diameter larger by a radial clearance C than a diameter of shaft portion 54*a* of restraint member 54 such that shaft portion 54*a* is allowed to be inserted into support hole 64*a* but restraining portion 54*b* interferes and engages with a peripheral portion that defines support hole 64*a*. The thus constructed floating mechanism with the radial clearance C formed between support hole 64*a* and restraint member 54 (shaft portion 54*a*) serves to ensure a freedom of movement of jig body 43 in the radial direction. By ensuring the freedom of movement of jig body 43 in the radial direction (that is, by allowing a radial movement of jig body 43 by a predetermined amount) using the floating mechanism, an offset of a central axis of jig body 43 (guide die 62) relative to fixed die 20 can be absorbed to thereby ensure good insertion operability of guide die 62 relative to fixed die 20.

Guide die 62 has large diameter portion 68 on an upper end portion thereof, and small diameter portion 69 on a lower end portion thereof. Large diameter portion 68 is placed on the upper surface of fixed die 20 when guide die 62 is engaged with fixed die 20. Small diameter portion 69 is inserted into the cavity CV and engaged with counterpart engaging portion 25 of fixed die 20. Small diameter portion 69 is a stepped and reduced diameter portion corresponding to that of core body 31 of moveable die 30. Small diameter portion 69 has engaging portion 132 on an outer periphery thereof which is engageable with counterpart engaging portion 25 of fixed die 20 and has the same configuration as that of engaging portion 32 of core body 31 of moveable die 30. That is, engaging portion 132 includes large diameter shaft portion 132*a*, tapered shaft portion 132*b*, and small diameter shaft portion 132*c* which have same shapes as those of large diameter shaft portion 32*a*, tapered shaft portion 32*b*, and small diameter shaft portion 32*c* of engaging portion 32. Further, guide die 62 has guide surface 62*a* on an inner periphery thereof which has a uniform inner diameter in an axial direction thereof. When guide die 62 is moved relative to body 61, guide surface 62*a* comes into slide contact with guide portion 65 of body 61. As a result, it is possible to ensure smooth insertion of guide die 62 into the cavity CV of fixed die 20 in accordance with suitable descending and ascending movement of guide die 62.

Core retaining mechanism 44 is constructed to be operated by air pressure. Core retaining mechanism 44 is accommodated on an inner peripheral side of guide portion 65 of body 61, and is rotatably supported on base portion 63 through stepping motor 45. Core retaining mechanism 44 retains core 10 so as to clamp core 10 from an outer peripheral side thereof, thereby serving for transportation of core 10. Specifically, core retaining mechanism 44 includes generally disk-shaped base member 71 supported on base portion 63 through stepping motor 45, and a plurality of moveable pawls 72 disposed on an outer peripheral portion of base member 71. Moveable pawls 72 downwardly extend along an axial direction of guide portion 65, and are arranged in a circumferential direction of base member 71 at substantially equal intervals. In this embodiment, three or more moveable pawls 72 are provided. Moveable pawls 72 are moveable along a radial direction of base member 71 in accordance with air pressure introduced into base member 71, thereby serving as chuck 73 that retains core 10 from the outer peripheral side of core 10. In addition, push member 74 is disposed on an inner peripheral side of chuck 73, and serves to push out core 10 retained by chuck 73 therefrom as rods 42*b*, 42*b* of air cylinders 42, 42 project downwardly.

Stepping motor 45 is driven and controlled on the basis of results of analysis by image analyzer 81 (see FIG. 6) that serves to recognize positions (circumferential positions) of fitting holes 11, 11 of core 10 that is picked up through core retaining mechanism 44. Core retaining mechanism 44 is rotated by stepping motor 45 on the basis of the results of analysis by image analyzer 81, thereby carrying out positioning of core 10 relative to fixed die 20 in the circumferential direction, that is, positioning of fitting holes 11, 11 of core 10 relative to fitting projections 24, 24 of fixed die 20. Image analyzer 81 serves to analyze positions of fitting holes 11, 11 by binarizing an image of a bottom surface of core 10 which is read in through a camera.

A method for producing piston 1 using the above-described apparatus will be explained hereinafter by referring to FIG. 2 to FIG. 13.

Figure 5C:
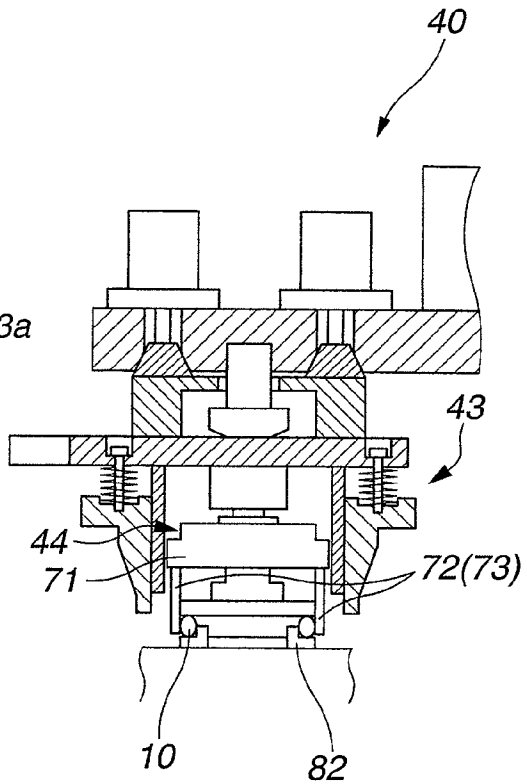
FIGS. 5A-5C are sectional views of the essential part of the apparatus according to the first embodiment of the present invention, and show a first step of the method of the present invention.
Figure 5B:
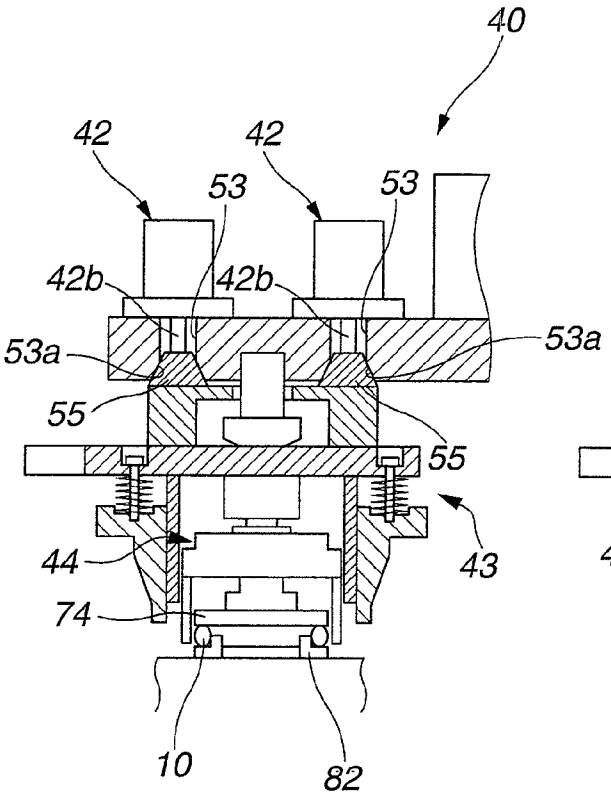
Figure 5A:
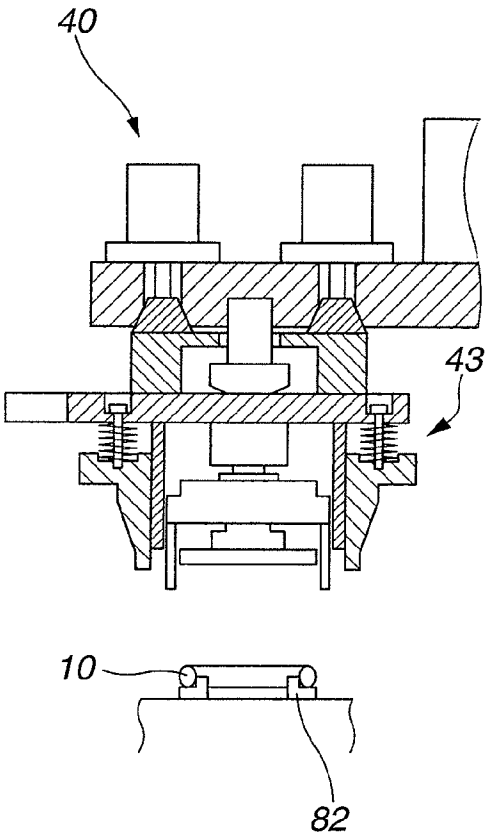
Figure 6A:
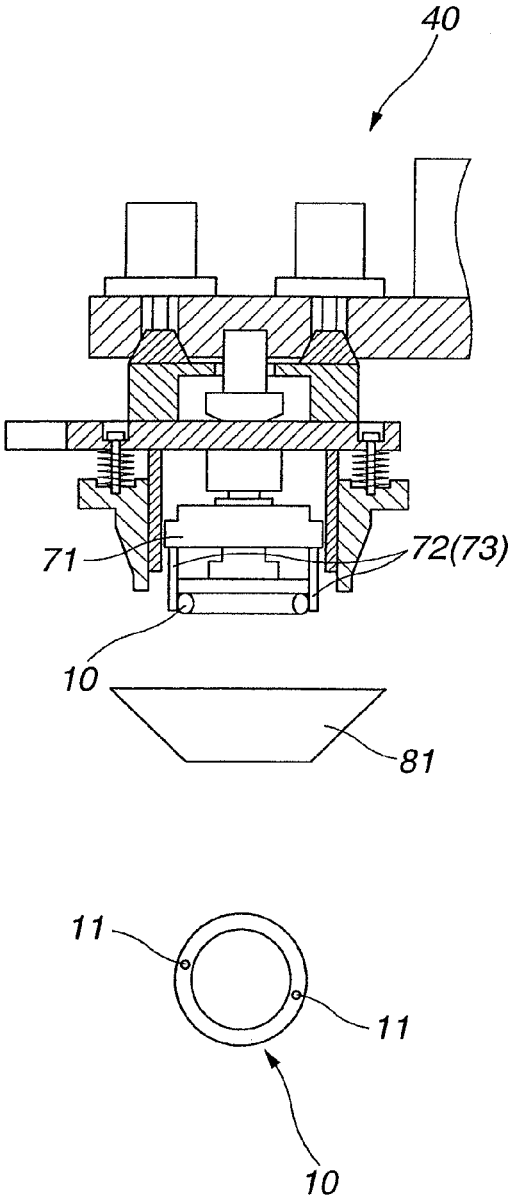
FIGS. 6A-6B are sectional views of the essential part of the apparatus according to the first embodiment of the present invention, and show a step of correcting a position of the core which is carried out between the first step and a second step of the method of the present invention.
Figure 6B:
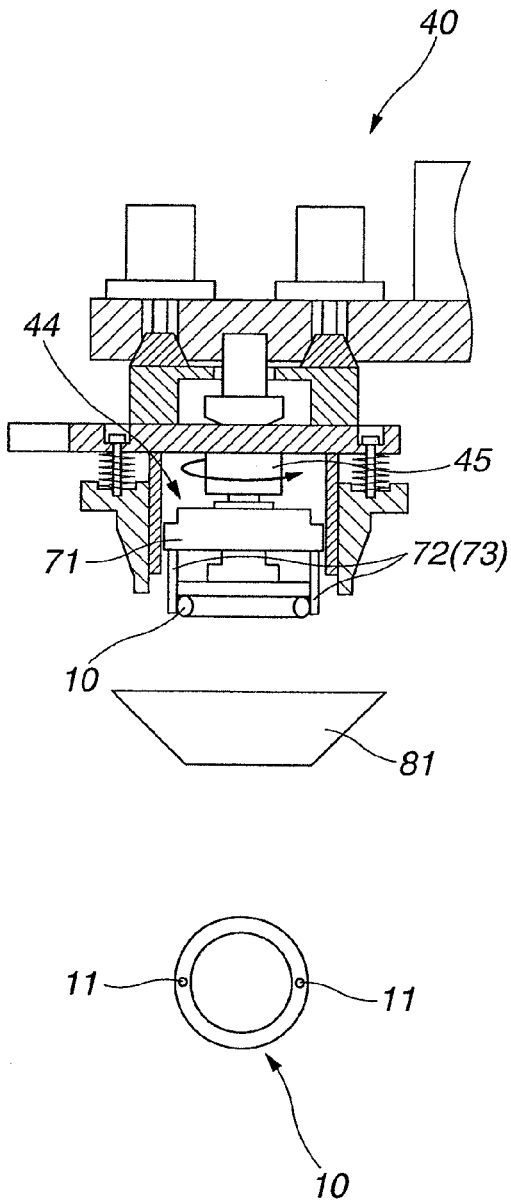

First, core 10 is fixedly placed in the cavity CV through fitting projections 24, 24 of fixed die 20. Specifically, as shown in FIG. 5A, core 10 previously heated is placed in a predetermined position on positioning pedestal 82 arranged coaxially with jig body 43. Subsequently, the apparatus is actuated. As shown in FIG. 5B, jig 40 as a whole starts descending movement under a condition that an amount of projection of rods 42*b*, 42*b* of air cylinder 42, 42 is minimum and connecting members 55, 55 are engaged with support body 41 (tapered portions 53*a*, 53*a* of rod insertion holes 53, 53), that is, under a condition that the floating mechanism is locked, until core retaining mechanism 44 is downwardly moved to a predetermined position. At this time, positioning pedestal 82 is set on a belt conveyer having a large elasticity, and therefore, push member 74 is brought into contact with core 10 and stopped due to a reaction force of the belt conveyer. Next, as shown in FIG. 5C, air pressure is introduced into base member 71 so that pawls 72 are urged to move in a radially inward direction of base member 71 (that is, chuck 73 is reduced in diameter) and engage the outer periphery of core 10 to thereby retain core 10 (the first step according to the invention). After that, as shown in FIG. 6A, jig 40 as a whole is ascended and moved to a position just above image analyzer 81 while retaining core 10 through core retaining mechanism 44. A state of the bottom surface of core 10 (i.e., circumferential positions of fitting holes 11, 11) is analyzed by image analyzer 81. Next, as shown in FIG. 6B, core retaining mechanism 44 is allowed to rotate on the basis of the results of analysis, so that a circumferential position of core 10 is adjusted.

In this embodiment, positioning pedestal 82 serving for readily arranging core 10 is used. However, instead of using positioning pedestal 82, core 10 can be directly placed on the belt conveyer and directly picked up by detecting the position of core 10 with a camera that is mounted to the robot arm as the transport machine.

Figure 7:
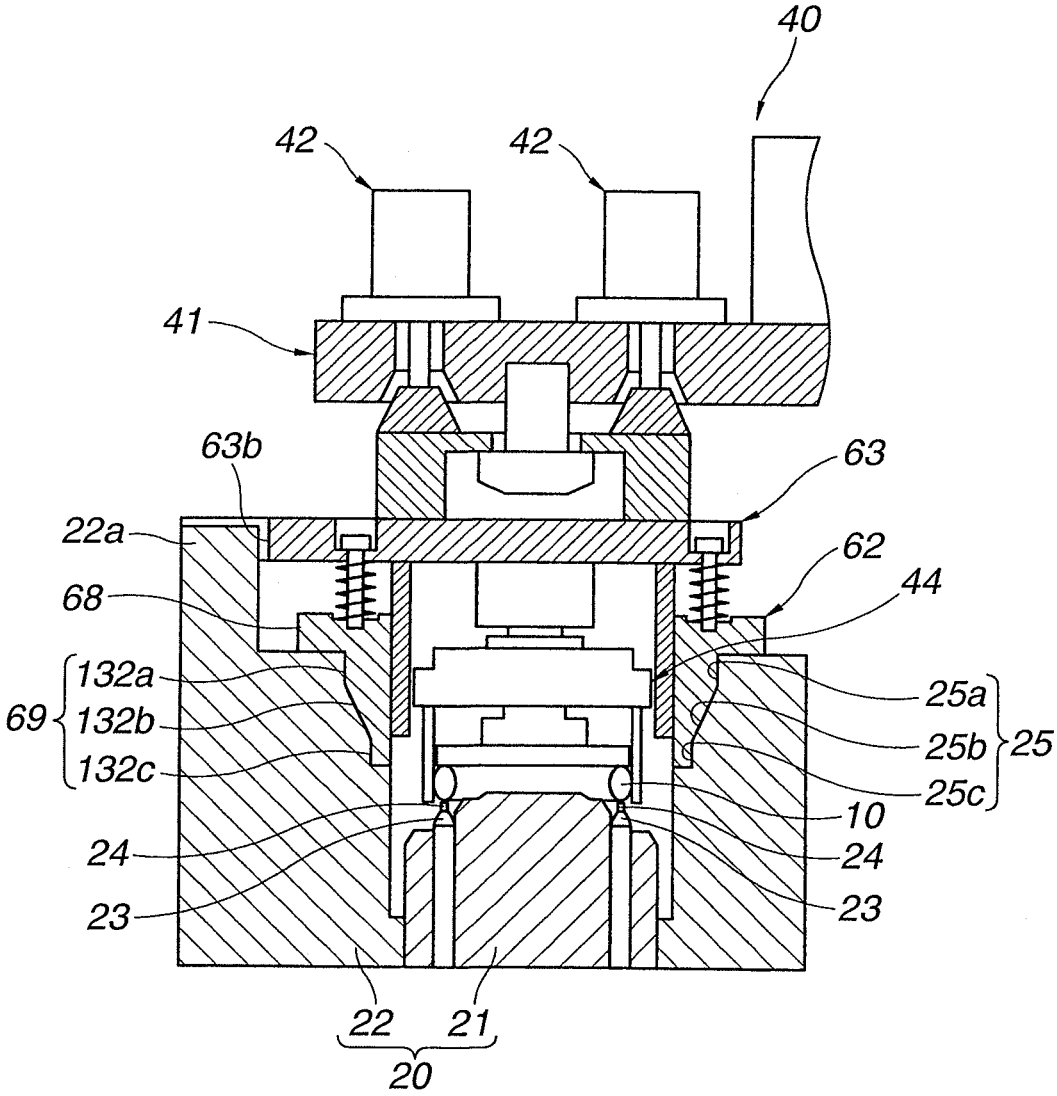
FIG. 7 is a sectional view of the essential part of the apparatus according to the first embodiment of the present invention, and shows the second step of the method of the present invention.

After core 10 is thus retained in a suitable state by jig 40, as shown in FIG. 4, jig 40 is moved to a position substantially coaxial with fixed die 20 previously assembled. Subsequently, as shown in FIG. 7, support body 41 is downwardly moved to thereby descend whole jig 40 under a condition that the floating mechanism is unlocked by introducing some amount of an air pressure into air cylinders 42, 42. At this time, a tip end of small diameter shaft portion 132*c* of guide die 62 comes into slide contact with a peripheral surface of tapered bored portion 25*b* of fixed die 20, and tapered shaft portion 132*b* of guide die 62 comes into slide contact with a peripheral edge of large diameter bored portion 25*a* of fixed die 20. Thus, owing to the tapered configurations of engaging portion 132 of guide die 62 and counterpart engaging portion 25 of fixed die 20, jig 40 is introduced and guided into fixed die 20, so that small diameter portion 69 of guide die 62 is brought into engagement with aperture 20*a* of fixed die 20, and engaging groove 63*b* of base portion 63 is brought into engagement with engaging projection 22*a* of fixed die 20. When a lower surface of large diameter portion 68 of guide die 62 is contacted with the upper surface of fixed die 20, the descending movement of whole jig 40 in accordance with the downward movement of support body 41 is stopped (the second step according to the invention).

As described above, in this embodiment, in view of engaging jig 40 with fixed die 20, guide die 62 is provided with engaging portion 132 similar to engaging portion 32 of core body 31 of moveable die 30, and the floating mechanism that serves to ensure a freedom of jig body 43 in the radial direction is provided. With this construction, even in a case where jig 40 is displaced in the horizontal direction to a certain extent upon inserting and engaging jig 40 in fixed die 20, jig 40 can be engaged with fixed die 20 so as to carry out centering of jig 40 relative to fixed die 20 owing to the guide function of the tapered configurations of both engaging portion 132 of guide die 62 and counterpart engaging portion 25 of fixed die 20. After that, when core 10 is engaged with fixed die 20 and fixed thereto through fitting projections 24, 24, positioning of core 10 can be automatically and readily performed.

Figure 8:
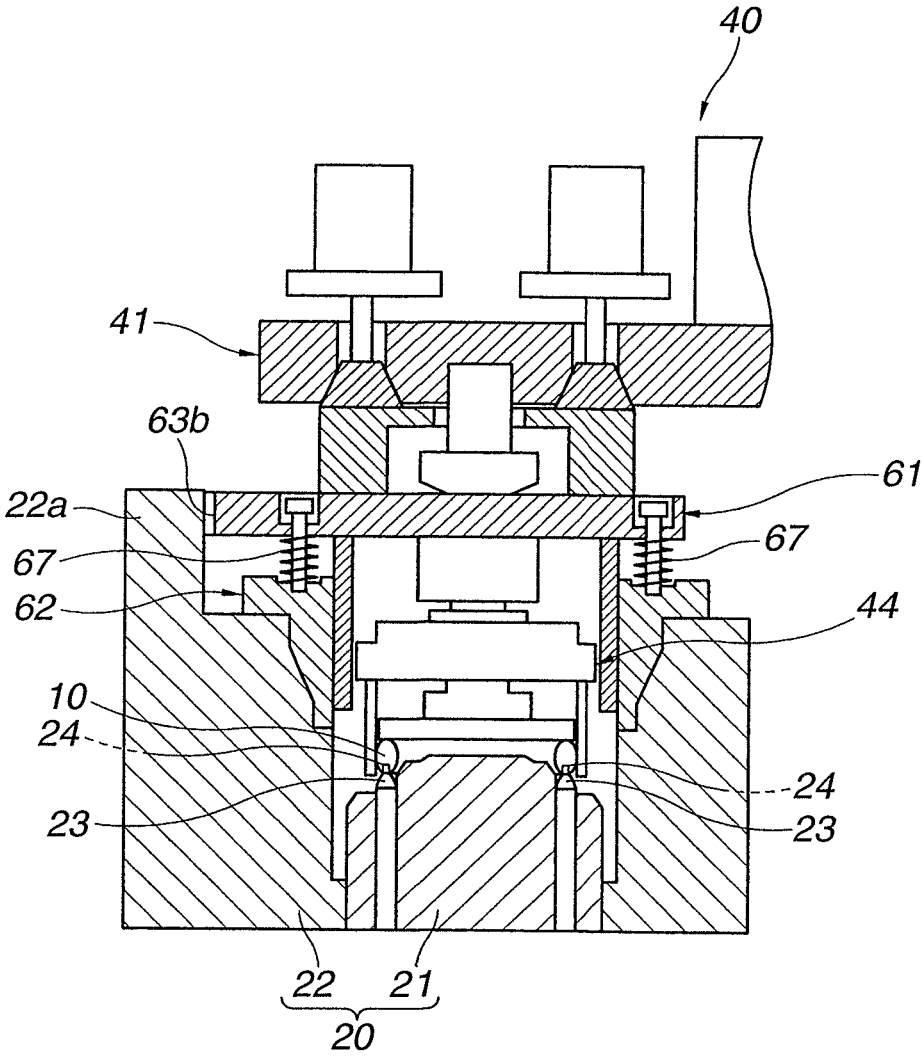
FIG. 8 is a sectional view of the essential part of the apparatus according to the first embodiment of the present invention, and shows a third step of the method of the present invention.
Figure 9:
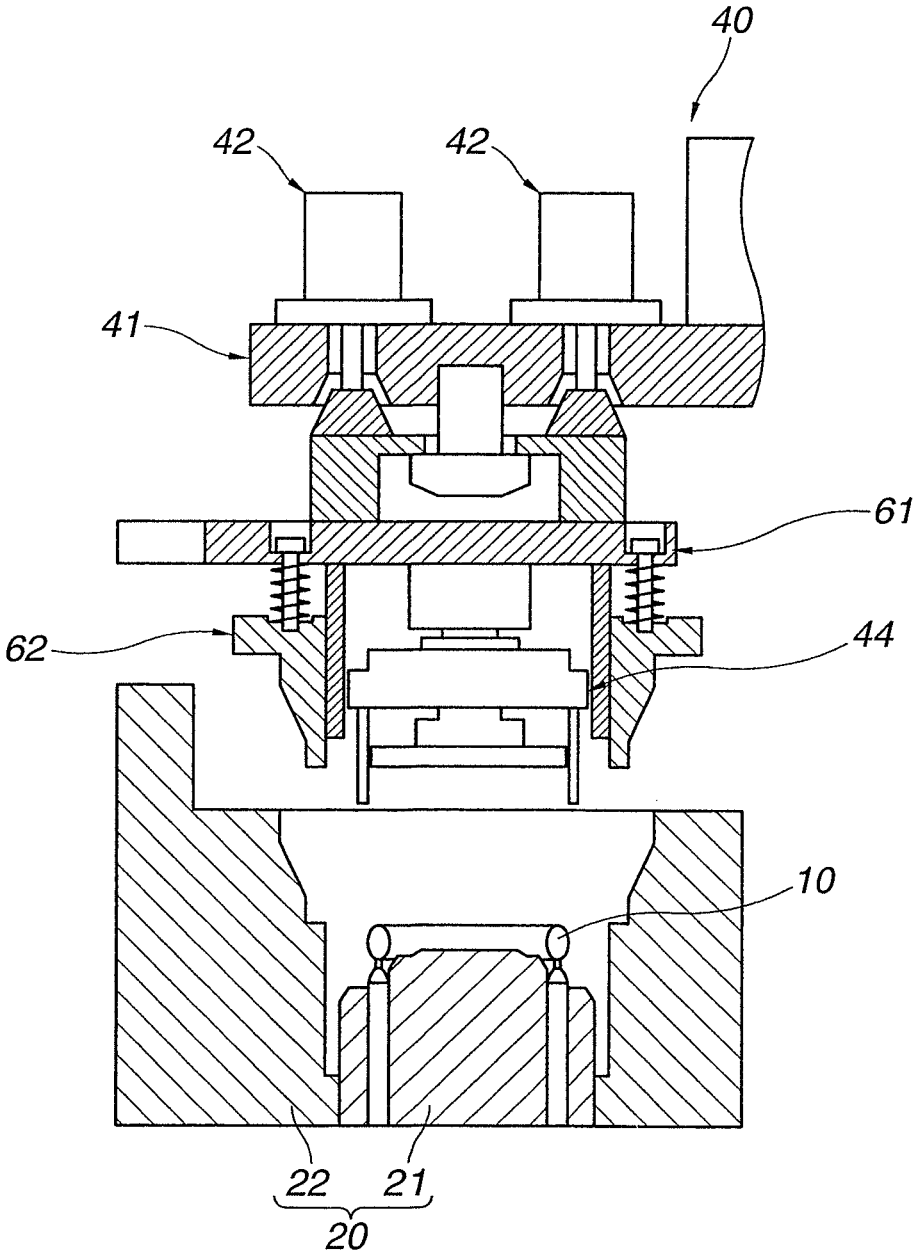
FIG. 9 is a sectional view of the essential part of the apparatus according to the first embodiment of the present invention, and shows a fourth step of the method of the present invention.

Subsequently, after guide die 62 is engaged with fixed die 20, as shown in FIG. 8, a pressing force is applied to support body 41 and urges support body 41 to further downwardly move against the biasing force of coil springs 67, so that body 61 is allowed to further downwardly move relative to guide die 62. As a result, core retaining mechanism 44 as a whole is descended together with body 61, so that fitting projections 24, 24 of fixed die 20 are press-fitted into fitting holes 11, 11 of core 10 retained by core retaining mechanism 44. Core 10 is thus brought into engagement with fixed die 20 and secured to fixed die 20 (the third step of the invention).

Further, when body 61 is allowed to descend relative to guide die 62, stop of the descending movement of body 61 is determined on the basis of an amount of the descending movement detected by a seat sensor or a displacement sensor (not shown). At this time, the descending movement may be mechanically locked. In such a case, it is necessary to detect a load that is exerted on the transport machine.

Further, in this embodiment, the circumferential positions of fitting holes 11, 11 of core 10 are adjusted by image analyzer 81 as described above. Therefore, only by pushing body 61 together with support body 41 into fixed die 20, fitting projections 24, 24 can be automatically and surely pressed into fitting holes 11, 11 of core 10, thereby readily and properly performing engagement and fixing of core 10 relative to fixed die 20. In addition, in a case where image analyzer 81 is used, a position of core 10 (fitting holes 11, 11) can be detected in a non-contact condition, and therefore, it is possible to perform detection and adjustment of the position of core 10 with a simple construction.

In this embodiment, circumferential positioning of guide die 62 relative to fixed die 20 is carried out using a so-called key engagement between engaging projection 22*a* and engaging groove 63*b*. As a result, a maximum effect of positional adjustment by the above-described image analysis can be obtained so that core 10 is more accurately engaged with fixed die 20 and secured to fixed die 20.

After engaging core 10 with fixed die 20 as described above, as shown in FIG. 9, support body 41 is lifted up by the transport machine (not shown) so that jig 40 as a whole is ascended through air cylinders 42, 42. Thus, fixing and arrangement of core 10 relative to fixed die 20 is completed (the fourth step according to the invention).

Figure 10:
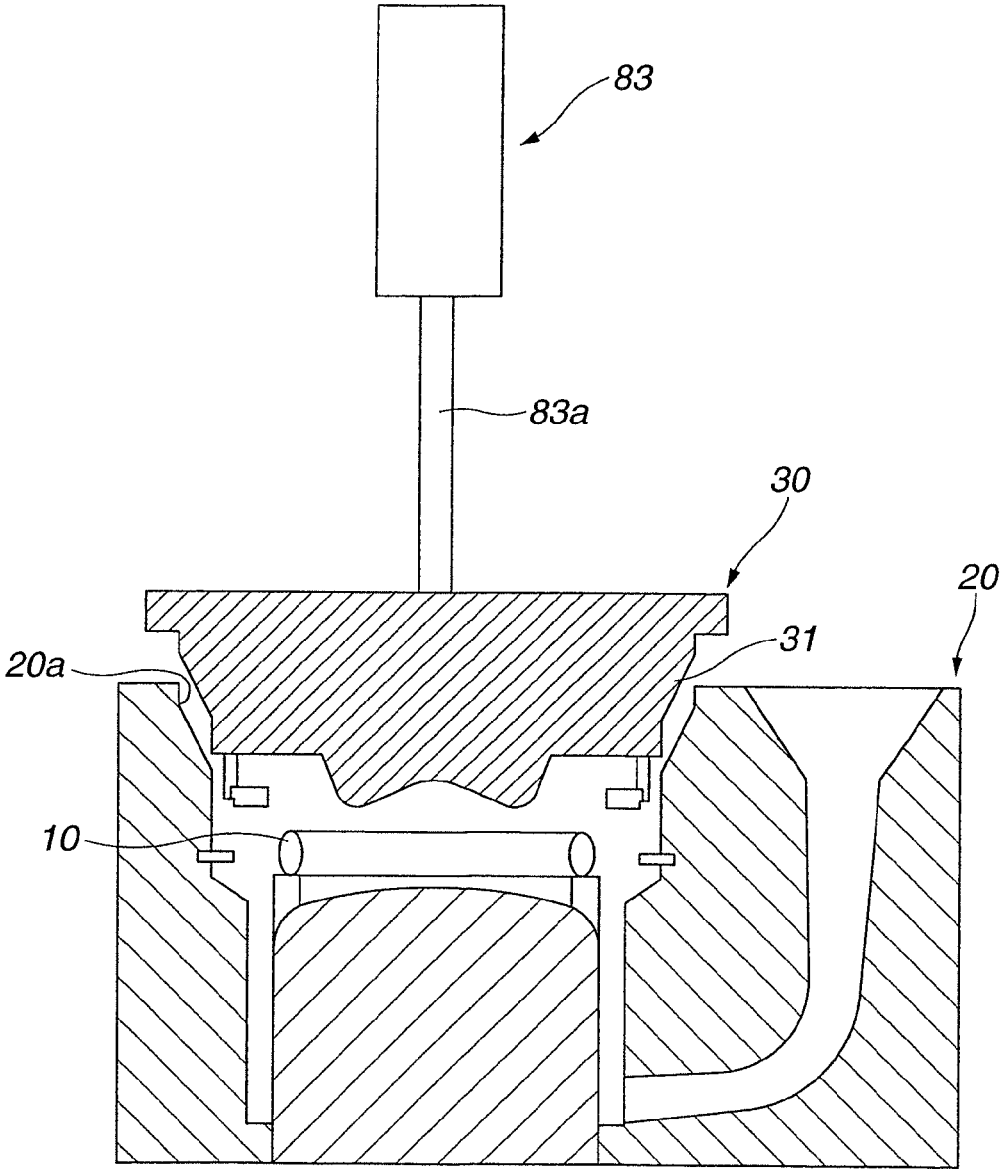
FIG. 10 is a sectional view of the essential part of the apparatus according to the first embodiment of the present invention, and shows a state immediately before pouring a molten metal in the fixed die in a fifth step of the method of the present invention.

Subsequent to completion of the fixing and arrangement of core 10 relative to fixed die 20, jig 40 is allowed to move to an initial position (the set position of core 10), and moveable die 30 is allowed to move to a position substantially coaxial with fixed die 20 as shown in FIG. 2. Then, as shown in FIG. 10, hydraulic cylinder 83 as the moving mechanism is actuated to project rod 83*a* by a predetermined amount, thereby descending moveable die 30 by the predetermined amount such that a part of core body 31 of moveable die 30 is inserted into aperture 20*a* of fixed die 20. Moveable die 30 is allowed to temporarily stop, and is held in this position as shown in FIG. 10.

Figure 11:
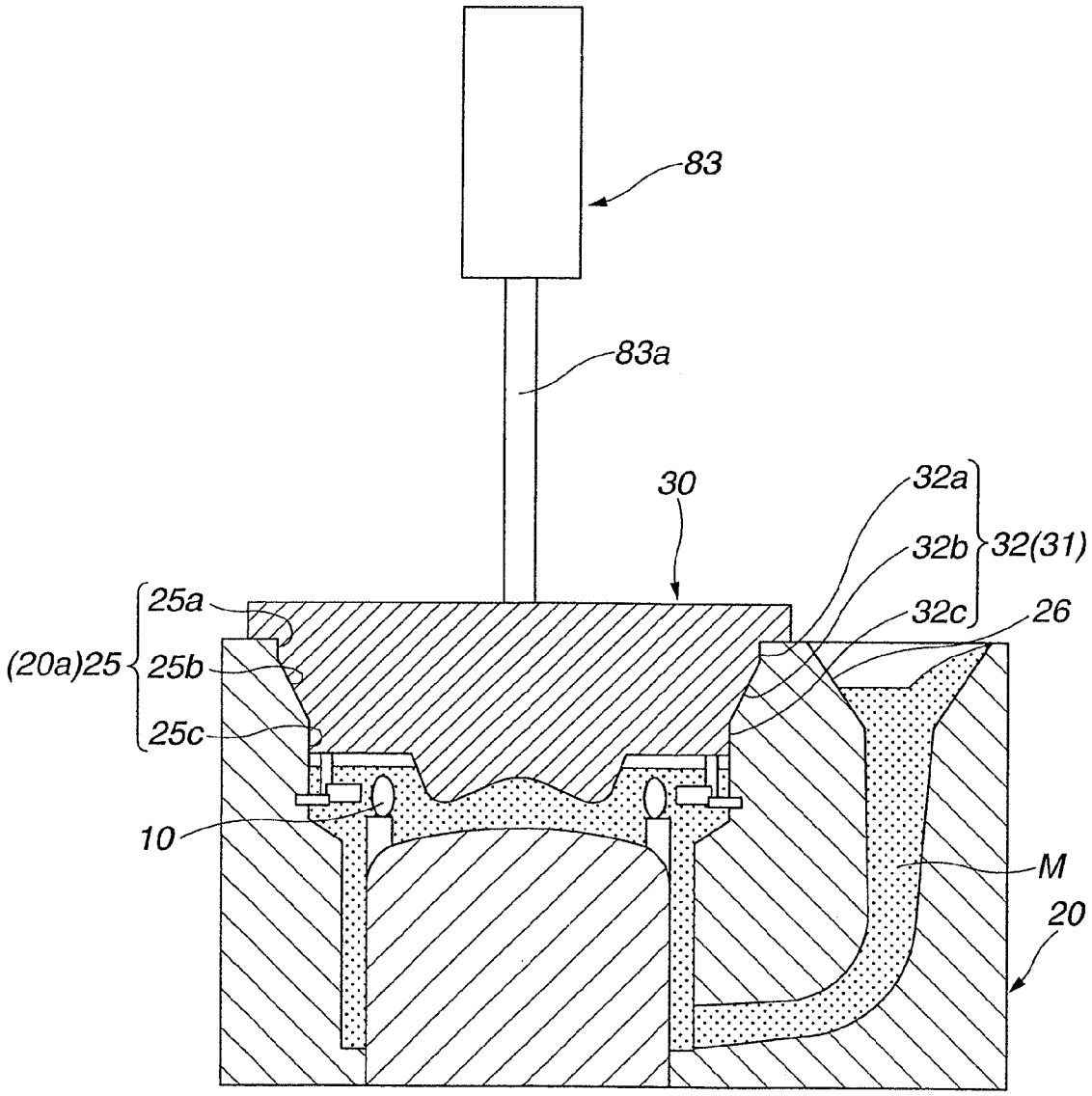
FIG. 11 is a sectional view of the essential part of the apparatus according to the first embodiment of the present invention, and shows a state in the course of pouring the molten metal in the fixed die in the fifth step of the method of the present invention.

Next, as shown in FIG. 11, molten metal M is poured into gate 26 of fixed die 20 (second die part 22) to fill the cavity CV therewith. Specifically, after the molten metal M is poured until a surface thereof reaches a position slightly higher than an upper end of core 10, moveable die 30 is allowed to further descend such that engaging portion 32 of moveable die 30 (core body 31) is completely engaged with counterpart engaging portion 25 of fixed die 20, thereby closing aperture 20*a* (the fifth step according to the invention).

Figure 12:
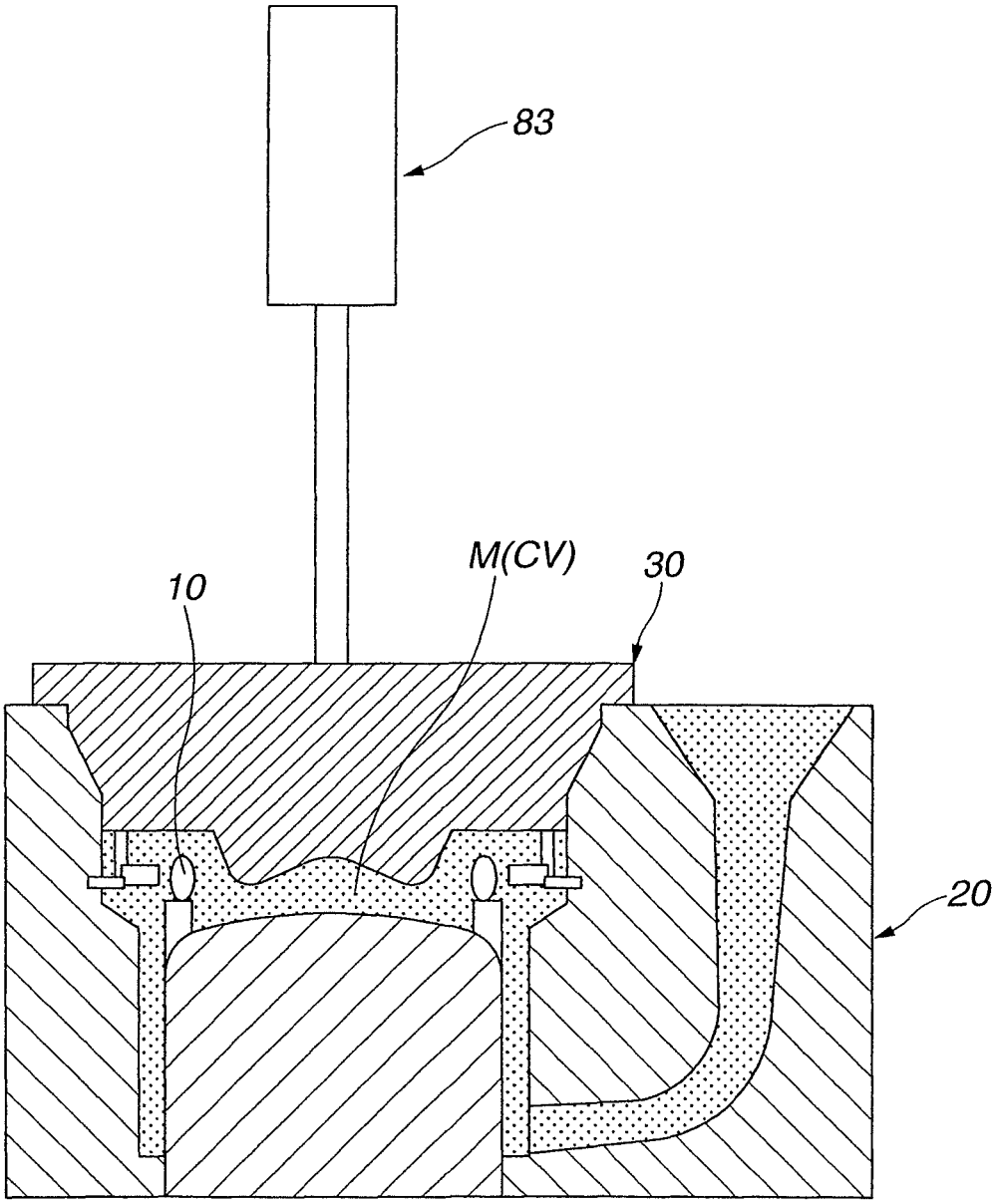
FIG. 12 is a sectional view of the essential part of the apparatus according to the first embodiment of the present invention, and shows a state in which the molten metal is filled in the die in the fifth step of the method of the present invention.
Figure 13:
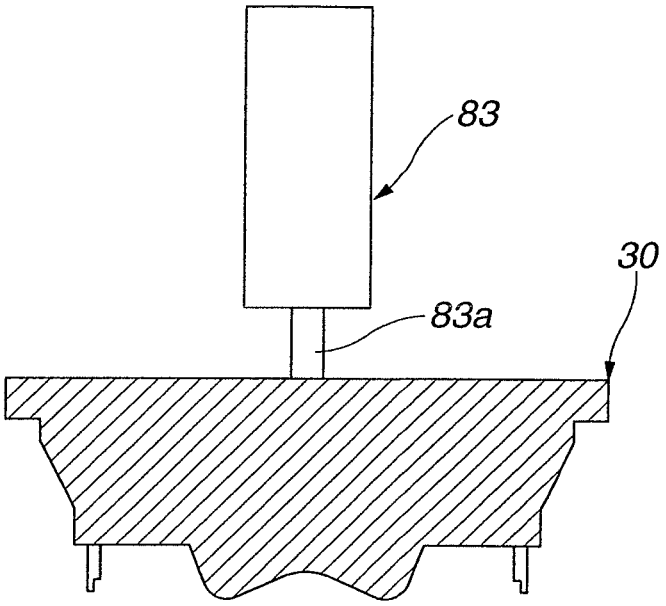
FIG. 13 is a sectional view of an essential part of the apparatus according to the first embodiment of the present invention, and shows a state in which casting of the molten metal is completed in the fifth step of the method of the present invention.
Figure 13:
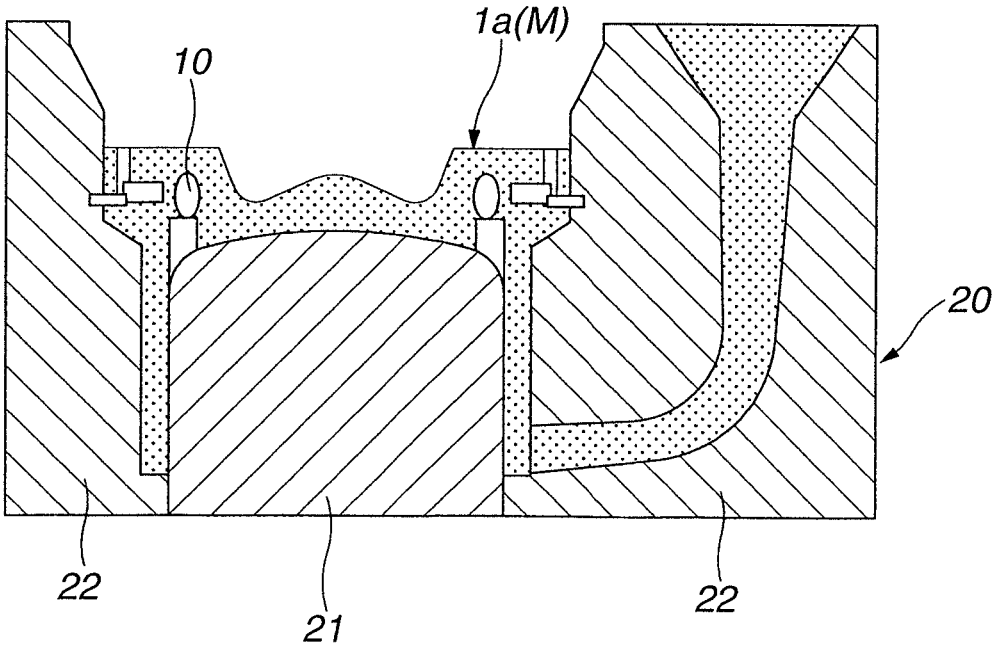

After that, pouring of the molten metal M is continued and then finished when the cavity CV is completely filled with the molten metal M as shown in FIG. 12. After the molten metal M is cooled and solidified, as shown in FIG. 13, moveable die 30 is allowed to ascend and release from fixed die 20. Subsequently, fixed die 20 is disassembled to thereby withdraw piston workpiece 1*a* casted. Finally, water is injected into piston workpiece 1*a* through one of introduction hole 6 and discharge hole 7 to thereby dissolve core 10, and piston workpiece 1*a* is subjected to necessary machining such as grinding and polishing to thereby obtain piston 1 as a complete product.

As explained above, in this embodiment, soluble core 10 is arranged in the cavity CV of fixed die 20 by using guide die 62 of jig 40 that has engaging portion 132 similar to engaging portion 32 of moveable die 30. By using guide die 62, centering (horizontal positioning) of core 10 relative to fixed die 20 can be attained so that core 10 can be automatically arranged in a precise position in the cavity CV in the horizontal direction. As a result, it is possible to automate arrangement of core 10, thereby serving for enhancing productivity of piston 1.

Further, engaging portion 32 and engaging portion 132 include tapered shaft portion 32*b* and tapered shaft portion 132*b*, respectively, as a guide portion which are disposed on the side of the tip ends of engaging portion 32 and engaging portion 132. Moveable die 30 and guide die 62 are inserted into the cavity CV of fixed die 20 through tapered shaft portion 132*b*, and are engaged with fixed die 20. Therefore, with the provision of tapered shaft portions 32*b*, 132*b*, insertion ability of moveable die 30 and guide die 62 relative to fixed die 20 can be enhanced. As a result, it is possible to obtain good productivity of piston 1 and enhance positioning accuracy, thereby serving for effectively automating arrangement of core 10.

Further, core retaining mechanism 44 is slidably guided on an inner peripheral surface of guide die 62 through guide portion 65 of body 61. With this construction, upon utilizing the above-described horizontal positioning of core 10 through guide die 62, core 10 can be straightly inserted into the cavity CV from above without being offset so that insertion and arrangement of core 10 relative to fixed die 20 can be more precisely carried out.

Further, core retaining mechanism 44 includes a chucking construction in which pawls 72 are slidable in the radial direction of base member 71. With this construction, when core retaining mechanism 44 retains core 10, core 10 can be retained in a state centered relative to core retaining mechanism 44. As a result, positioning of core 10 relative to fixed die 20 can be readily and effectively carried out.

Further, in this embodiment, in order to fixedly arrange core 10 relative to fixed die 20, fixed die 20 is provided with fitting projections 24, 24, and core 10 is provided with fitting holes 11, 11 engageable with fitting projections 24, 24 in a press-fit state. The convexo-concave (male and female) engagement can serve for proper positioning of core 10. Further, it is possible to ensure quality and yield of piston 1 and suppress such a problem that core 10 rises to a surface of the molten metal poured into the cavity CV during pouring the molten metal. As a result, casting of piston 1 having cooling channel 5 can be effectively carried out.

Further, in this embodiment, upon fixedly arranging core 10, fitting holes 11, 11 formed in the bottom of core 10 are fitted to fitting projections 24, 24 raised on fixed die 20. Therefore, core 10 can be secured to fixed die 20 only by pushing core 10 toward fitting projections 24, 24 from an upper side of core 10. As a result, it is possible to ensure good productivity of piston 1.

Furthermore, in this embodiment, the apparatus is provided with coil springs 67 that biases guide die 62 in a direction in which core retaining mechanism 44 is slidable and core 10 is moved away from fixed die 20. With the provision of coil springs 67, when core 10 is secured to fixed die 20 (fitting projections 24, 24), core 10 can be engaged (or press-fitted) on fitting projections 24, 24 with substantially no impact, thereby serving for suppressing a problem that core 10 is broken upon fitting core 10 onto fitting projections 24, 24.

In addition, in this embodiment, core retaining mechanism 44 is constructed such that core 10 is retained by chuck 73 that slides from a radially outer side of core 10 toward a radially inner side of core 10 so as to reduce a distance between pawls 72 opposed to each other in a radial direction of core 10 upon retaining core 10. With this construction, even in a case where a sufficient space cannot be ensured on an inner peripheral side of core 10 due to a relation with fixed die 20 (a shape of the piston), centering of core 10 can be attained to thereby serve for effectively automating arrangement of core 10.

Figure 14:
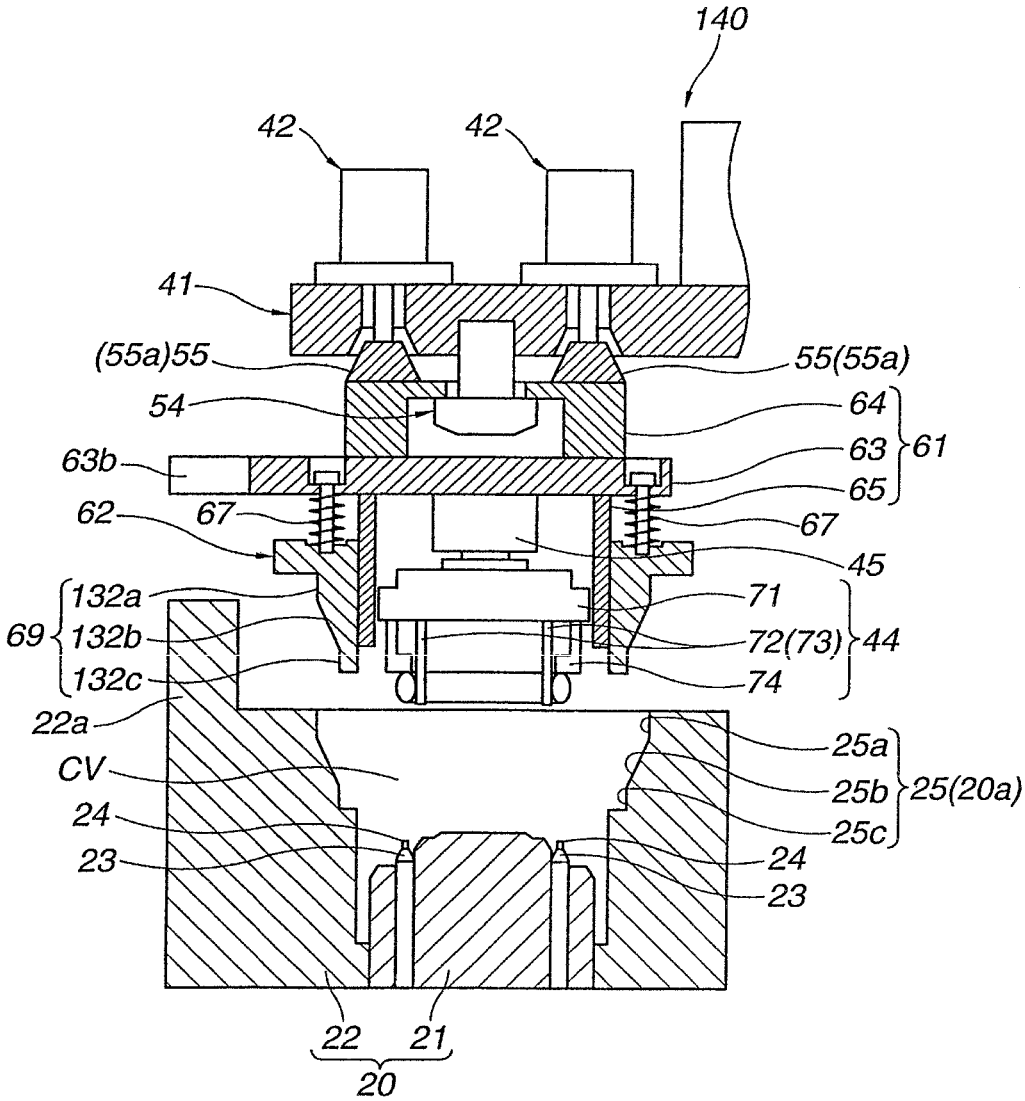
FIG. 14 is a sectional view similarly to FIG. 4, but shows an essential part of an apparatus for producing a piston for an internal combustion engine according to a second embodiment of the present invention.

FIG. 14 shows an apparatus for producing a piston for an internal combustion engine according to a second embodiment of the present invention. The second embodiment differs from the first embodiment in that a retaining configuration of core retaining mechanism 44 of jig 140 is modified. Like reference numerals denote like parts, and therefore, detailed explanations therefor are omitted.

In this embodiment, core retaining mechanism 44 of jig 140 includes pawls 72 slidable from the radially inner side of core 10 toward the radially outer side of core 10 so as to increase a distance between pawls 72 opposed to each other in the radial direction of core 10. Core 10 is retained by pressure contact between the inner peripheral portion of core 10 and pawls 72.

Specifically, in core retaining mechanism 44 of jig 140, generally cylindrical push member 74 is disposed on an outer peripheral side of base member 71, and chuck 73 including at least three pawls 72 is disposed on an inner peripheral side of push member 74. Chuck 73 is slidable from the radially inner side of core 10 toward the radially outer side of core 10 so as to increase a distance between pawls 72 opposed to each other in the radial direction of core 10.

The shape of push member 74 is not limited to a circumferentially continuous cylindrical shape, and may be any shape, for example, a circumferentially discontinuous cylindrical shape, and a spot-like shape constituted of two or three pieces spaced from each other in the radial direction of base member 71, as long as core 10 chucked by pawls 72 can be pushed out as described in the first embodiment.

As described above, in the second embodiment, core retaining mechanism 44 is constructed such that core 10 is retained from the inner peripheral side thereof. With this construction, the second embodiment can perform the same function and effect as those of the first embodiment. In addition, even in a case where a sufficient space on the outer peripheral side of core 10 cannot be ensured due to a relation with fixed die 20 (the shape of piston), centering of core 10 can be attained to thereby effectively automate the arrangement of core 10.

The present invention is not limited to the above-described embodiments. A specific shape of piston 1, for example, configuration (layout) of cooling channel 5, can be variously modified in accordance with specification, etc. of piston 1. In other words, the apparatus and method for producing a piston for an internal combustion engine according to the present invention can be applied to any piston having a cooling channel opened downwardly regardless of a shape of the piston.

Further, in the above-described embodiments, upon carrying out engagement and fixing of core 10 relative to fixed die 20, positional adjustment of fitting holes 11, 11 of core 10 is conducted using image analyzer 81. However, the positional adjustment by image analyzer 81 and provision of fitting holes 11, 11 of core 10 are not essential in the apparatus of the present invention. That is, since core 10 is made of salt, engagement and fixing of core 10 relative to fixed die 20 can be suitably and properly performed by forming tip ends of fitting projections 24, 24 into a tapered shape and pressing the tapered tip ends onto core 10 with a suitable load even in a case where fitting holes 11, 11 are located offset to a little extent or are not formed in core 10.

Furthermore, a shape of engaging portion 32 of core body 31 of moveable die 30 may be modified. For instance, tapered shaft portion 32*b* is not necessarily disposed between large diameter shaft portion 32*a* and small diameter shaft portion 32*c*, and may be disposed at a tip end portion of engaging portion 32. In such a case, tapered shaft portion 32*b* may be merely a so-called chamfered portion, and a degree of chamfering is not particularly limited as long as the chamfered portion can guide guide die 62 upon inserting guide die 62 into the cavity CV of fixed die 20 through aperture 20*a*.

This application is based on a prior Japanese Patent Application No. 2012-94356 filed on Apr. 18, 2012, the entire contents of which is hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An apparatus for producing a piston for an internal combustion engine by casting, the piston having a cooling channel therein, the apparatus comprising:

a fixed die with an upwardly opened cavity in which a core serving to form the cooling channel is to be disposed;

a moveable die moveably disposed relative to the fixed die in a vertical direction, the moveable die comprising a predetermined engaging portion, the moveable die being inserted and engaged in the fixed die through the engaging portion to thereby serve to form a crown surface of the piston, a guide die comprising an engaging portion engageable with the fixed die, the engaging portion of the guide die having a same shape as that of the engaging portion of the moveable die, and a core retaining mechanism disposed in the guide die, the core retaining mechanism serving to retain the core in a predetermined position, wherein after the guide die retaining the core through the core retaining mechanism is engaged with the fixed die to arrange the core in the cavity, the guide die is moved apart from the fixed die, and then the moveable die is inserted and engaged in the fixed die to thereby carry out casting of the piston.

2. The apparatus as claimed in claim 1, wherein the engaging portion of the moveable die and the engaging portion of the guide die each have a generally cylindrical shape, wherein the fixed die comprises an aperture that is opened to an upper surface of the fixed die and communicated with the cavity, the aperture having a circular shape in section and serving as a counterpart engaging portion engageable with the engaging portion of the moveable die and the engaging portion of the guide die, and wherein the engaging portion of the moveable die and the engaging portion of the guide die are engaged with the counterpart engaging portion to carry out positioning of the moveable die and the guide die relative to the fixed die in a horizontal direction.

3. The apparatus as claimed in claim 2, wherein the engaging portion of the moveable die and the engaging portion of the guide die each comprise a tapered guide portion through which the moveable die and the guide die are guided to the fixed die and inserted and engaged in the fixed die.

4. The apparatus as claimed in claim 1, wherein the core comprises a fitting portion through which the core is fittable to a support disposed in the fixed die, the fitting portion being fitted to the support to thereby secure and arrange the core in the cavity of the fixed die through the support.

5. The apparatus as claimed in claim 4, wherein the fitting portion is in the form of a concaved portion, and the support is in the form of a projection disposed to uprightly project from an inner bottom surface of the fixed die.

6. The apparatus as claimed in claim 1, wherein the core retaining mechanism is constructed to retain the core in a state centered relative to the core retaining mechanism.

7. The apparatus as claimed in claim 6, wherein the core retaining mechanism is constructed to adjust a position of the core in a rotational direction thereof.

8. The apparatus as claimed in claim 7, wherein the rotational position of the core is detected by an image analyzer.

9. The apparatus as claimed in claim 6, wherein the core retaining mechanism is supported so as to be slidable relative to the guide die.

10. The apparatus as claimed in claim 9, wherein the core retaining mechanism is slidable by an air cylinder disposed on the guide die.

11. The apparatus as claimed in claim 9, wherein the core retaining mechanism comprises a spring that biases the guide die in a direction in which the core retaining mechanism is slidable and which is opposite to a direction in which the core is assembled to the fixed die.

12. The apparatus as claimed in claim 6, wherein the core has a generally annular shape, and the core retaining mechanism comprises a plurality of retaining portions disposed on an inner peripheral side of the core so as to be moveable from a radially inner side of the core toward a radially outer side of the core.

13. The apparatus as claimed in claim 6, wherein the core has a generally annular shape, and the core retaining mechanism comprises a plurality of retaining portions disposed on an outer peripheral side of the core so as to be moveable from a radially outer side of the core toward a radially inner side of the core.

14. The apparatus as claimed in claim 12, wherein the core retaining mechanism drives the retaining portions by air pressure.

15. The apparatus as claimed in claim 1, wherein the core has an annular shape.

16. The apparatus as claimed in claim 15, wherein the core is made of a material containing sodium chloride as a main component.

17. The apparatus as claimed in claim 2, wherein the counterpart engaging portion of the fixed die comprises a tapered guide portion through which the moveable die and the guide die are respectively guided to the fixed die and inserted and engaged in the fixed die.

18. A method for producing a piston for an internal combustion engine by casting using an apparatus, the piston having a cooling channel therein, the apparatus comprising:

a fixed die with an upwardly opened cavity in which a core serving to form the cooling channel is to be disposed;

a moveable die moveably disposed relative to the fixed die in a vertical direction, the moveable die comprising a predetermined engaging portion, the moveable die being inserted and engaged in the fixed die through the engaging portion to thereby serve to form a crown surface of the piston, a guide die comprising an engaging portion engageable with the fixed die, the engaging portion of the guide die having a same shape as that of the engaging portion of the moveable die, and a core retaining mechanism disposed in the guide die, the core retaining mechanism serving to retain the core in a predetermined position, the method comprising:

a first step of retaining the core in a predetermined position through the core retaining mechanism;

a second step of inserting and engaging the guide die in the fixed die to thereby carry out positioning of the guide die relative to the fixed die through the engaging portion of the guide die;

a third step of arranging the core in the cavity of the fixed die through the core retaining mechanism;

a fourth step of removing the guide die from the fixed die; and a fifth step of inserting and engaging the moveable die in the fixed die.

19. The method as claimed in claim 18, wherein the first step comprises centering the core relative to the core retaining mechanism.

20. The method as claimed in claim 19, wherein the engaging portion of the guide die comprises a tapered guide portion formed on a side of a tip end of the engaging portion of the guide die, and the second step comprises correcting displacement of the guide die relative to the fixed die by sliding the tapered guide portion on an inner peripheral surface of an aperture that is opened to an upper surface of the fixed die and communicated with the cavity in a case where the guide die is displaced relative to the fixed die.

* * * * *